US011718434B2

(12) United States Patent
Bliemel et al.

(10) Patent No.: US 11,718,434 B2
(45) Date of Patent: Aug. 8, 2023

(54) PACKAGING DEVICE

(71) Applicant: SOMIC Verpackungsmaschinen GmbH & Co. KG, Amerang (DE)

(72) Inventors: Josef Bliemel, Amerang (DE); Bernhard Steffinger, Eiselfing (DE)

(73) Assignee: SOMIC VERPACKUNGSMASCHINEN GMBH & CO. KG, Amerang (DE)

( * ) Notice: Subject to any disclaimer, the term of this patent is extended or adjusted under 35 U.S.C. 154(b) by 300 days.

(21) Appl. No.: 17/117,180

(22) Filed: Dec. 10, 2020

(65) Prior Publication Data

US 2021/0221545 A1 Jul. 22, 2021

(30) Foreign Application Priority Data

Jan. 17, 2020 (DE) ..... 10 2020 200 534.6

(51) Int. Cl.

| | |
|---|---|
| ***B65B 43/10*** | (2006.01) |
| ***B65B 43/54*** | (2006.01) |
| ***B65B 5/02*** | (2006.01) |
| ***B65B 57/02*** | (2006.01) |
| ***B65B 65/00*** | (2006.01) |

(52) U.S. Cl.

CPC ..... *B65B 43/54* (2013.01); *B65B 5/024* (2013.01); *B65B 43/10* (2013.01); *B65B 57/02* (2013.01); *B65B 65/003* (2013.01)

(58) Field of Classification Search

CPC ..... B65B 65/003; B65B 57/02; B65B 43/08; B65B 43/10; B65B 43/52; B65B 43/54; B65B 5/024; B65B 35/24; B65B 35/44

See application file for complete search history.

(56) References Cited

U.S. PATENT DOCUMENTS

| | | | | |
|---|---|---|---|---|
| 4,509,312 | A * | 4/1985 | Nakajima | B65B 7/06 493/185 |
| 5,660,026 | A * | 8/1997 | Kinigakis | B65B 61/20 53/48.8 |
| 8,671,651 | B2 | 3/2014 | Poutot | |
| 2005/0262802 | A1 * | 12/2005 | Natterer | B65G 47/082 198/418 |

(Continued)

FOREIGN PATENT DOCUMENTS

DE 102016221887 5/2018

OTHER PUBLICATIONS

European Search Report for EP 20 21 7767 dated Jun. 4, 2021.

*Primary Examiner* — Anna K Kinsaul
*Assistant Examiner* — Himchan Song
(74) *Attorney, Agent, or Firm* — Rankin Hill & Clark, LLP

(57) ABSTRACT

A packaging device and a packaging method are disclosed in which, in a provisioning section, a plurality of folding boxes is arranged with the main cover flap projecting upward from a folding box shell, in which the folding boxes, in order to form a folding box group are conveyed in a first conveying direction from the provisioning section to a filling preparation section, with an offset device offsetting at least one of the folding boxes in a direction extending orthogonally to the first conveying direction by a predetermined offset distance and in which the folding box group is transferred along a second conveying direction from the filling preparation section to the filling section.

11 Claims, 2 Drawing Sheets

(56) References Cited

U.S. PATENT DOCUMENTS

Figure 1:
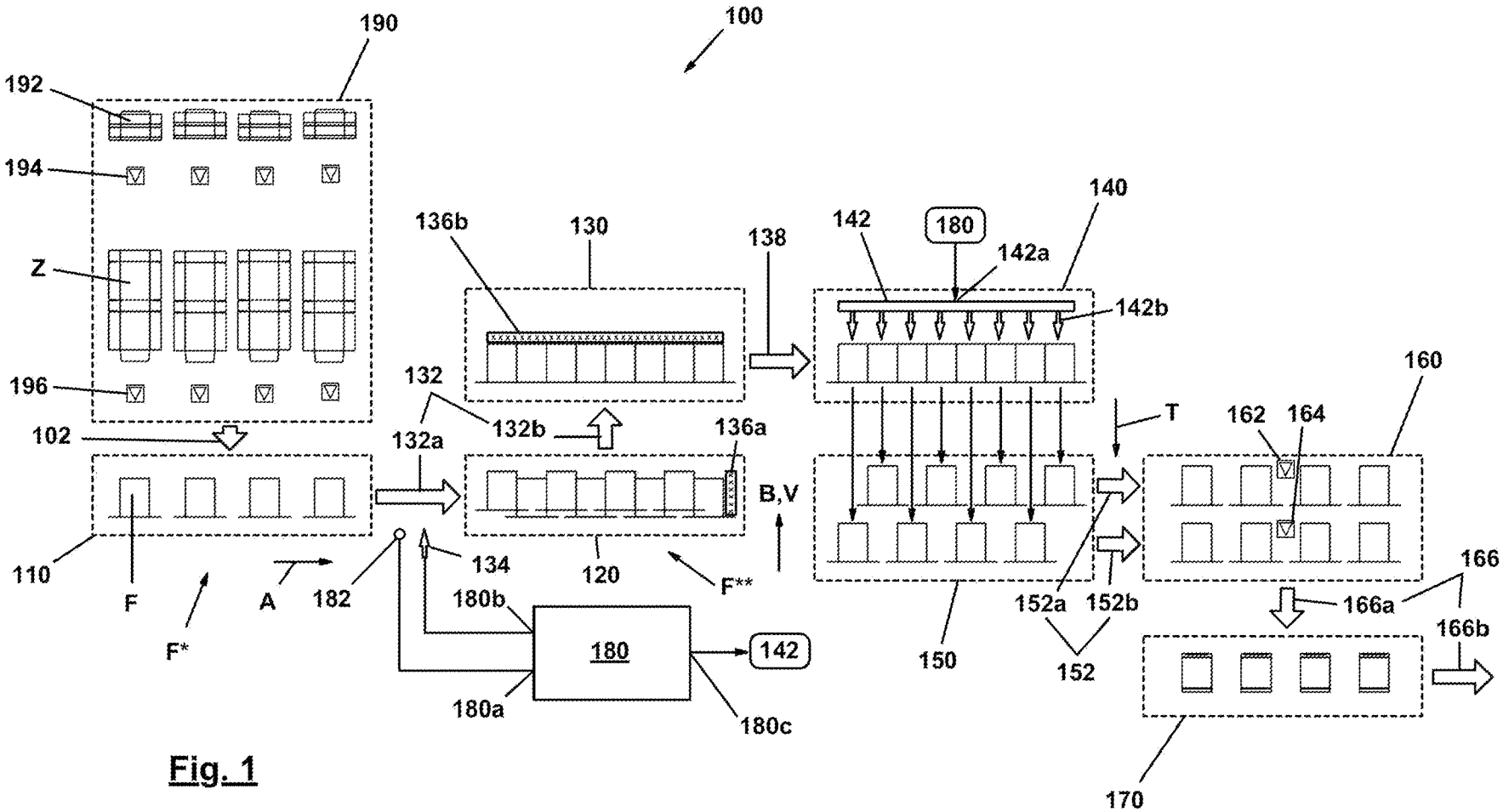

| | | | | |
|---|---|---|---|---|
| 2008/0092490 | A1* | 4/2008 | Schulte | B65B 35/58<br>53/446 |
| 2010/0170201 | A1* | 7/2010 | Aquarius | B65B 5/105<br>53/531 |
| 2017/0101274 | A1* | 4/2017 | Sullivan | B65G 1/12 |
| 2019/0135467 | A1* | 5/2019 | Mason | B65D 5/02 |
| 2020/0207550 | A1* | 7/2020 | De Boer | B65B 35/44 |
| 2022/0127029 | A1* | 4/2022 | Losert | B65B 35/36 |

* cited by examiner

PACKAGING DEVICE

The invention relates to a packaging device comprising a feeding device which is designed and intended to provide, in a provisioning section of the packaging device, a plurality of folding boxes formed from one folding box blank each in a so configuration in which a folding box shell of the particular folding box is arranged with a main cover flap that does not cover a shell opening of the folding box shell and cover side flaps that project laterally from this main cover flap and furthermore a conveying device which is designed and intended to convey the plurality of folding boxes from the provisioning section to a filling section with the conveying device comprising a first partial conveying device which is designed and intended to convey the plurality of folding boxes along a first conveying direction from the provisioning section to a filling preparation section as well as a second partial conveying device which is designed and intended to transfer the group of folding boxes along a second conveying direction from the filling preparation section to the filling section.

It should already be pointed out at this point that, according to the invention, the folding box shell is preferably formed in the packaging device. For this purpose, the packaging device can comprise at least one supply unit for, preferably substantially flat, folding box blanks, at least one extracting device and a folding box shell forming device. Preferably, a separate extracting device and a separate folding box shell forming device are assigned to each supply unit.

At this point it should be pointed out that both in the prior art and in the present invention a plurality of folding box groups can be transferred together from the filling preparation section to the filling section.

In the case of generic packaging devices, in order to ensure proper operation, it is generally necessary that adjacent folding boxes are placed at a distance from one another, said distance being at least twice the width of the cover side flaps. This is to prevent the folding boxes from touching one another. Such a contact could actually change their orientation and/or the alignment of the flaps, which would prevent a proper filling of the folding boxes. Due to the resulting arrangement of the folding boxes in the filling section, the grippers that pick up the products and insert them into the folding box shells have to be spread sideways. This additional spreading movement not only complicates the structural design of the packaging device but also limits the performance of the packaging device.

Alternatively, it might also be conceivable to convey the products at a distance that takes into account the distance between the folding boxes. However, this increases the space required and in turn limits the performance of the packaging device.

In contrast, it is the object of the invention to further develop the packaging device of the type mentioned above in such a way that performance is increased while maintaining a compact design.

According to the invention, this object is achieved by a packaging device of the type mentioned above in which an offset device is provided along the conveying path of the folding boxes from the provisioning section to the filling preparation section, which offset device is designed and intended to move at least one of the plurality of folding boxes in a direction that extends orthogonal to the first conveying direction by a predetermined offset distance and in which furthermore conveyance-limiting means are provided, which are designed and intended to limit the movement of the folding boxes under the action of the first partial conveying device along the first conveying direction.

The packaging device according to the invention makes it possible to arrange the folding boxes in such a way that their folding box shells touch one another. Due to the lateral contact of the folding box shells, the folding boxes even stabilize one another in their orientation. In addition, due to their offset, there is no risk that their cover side flaps touch one another. The compact arrangement of the folding boxes in the filling section also reduces the overall length of the packaging device. At the same time, there is no longer any need to spread the grippers that insert the products into the folding box shells, making it possible to increase performance.

In order to reduce the risk of the main cover flap of a folding box touching the folding box shells of the respective adjacent folding boxes and thus impairing their orientation, it is proposed in a further development of the invention that the cover side flaps of the folding boxes projecting laterally from the main cover flap taper at their end facing the folding box shells.

In principle, it is conceivable to fill the folding boxes in the filling section while they have the aforementioned offset from one another. For this purpose, a gripper provided for filling the folding boxes only has to be designed in such a way that, to compensate for the offset, it can be moved at least along the direction extending orthogonal to the first conveying direction. In further development of the invention, however, further conveyance-limiting means can be provided, which are designed and intended to cancel the offset of the folding boxes at the latest by the time the filling position is reached in the filling section. As a result, a gripper filling the folding box in the filling position only needs to be designed to grasp and release the products.

The offset device can, for example, be configured to offset the plurality of folding boxes in the direction extending orthogonal to the first conveying direction in such a way that they have a staggered offset. A first folding box may not have an offset distance, a subsequent second folding box may have a predetermined first offset distance and a third folding box following the second folding box may have a second offset distance which is greater than the first offset distance, etc. The entire effect may, however, be achieved simply by designing and intending the offset device to offset every second folding box by the predetermined offset distance.

To control the offset device, the packaging device according to one embodiment may furthermore comprise a control unit which comprises at least one signal input for detecting sensor signals and at least one signal output for sending control signals to the offset device.

If the packaging device according to the invention comprises such a control unit, it is possible, for example, to control the offset device in accordance with a conveying speed of the conveying device, in particular the first partial conveying device. In that case, however, it must be ensured that the folding boxes are always fed at a suitable point in time, i.e. at the same time intervals. In order to create an increased flexibility and precision of the packaging device according to the invention in this context, it is therefore proposed in a further development of this exemplary embodiment that the offset device also comprises a sensor unit which is connected to the at least one signal input of the control unit and is designed and intended to detect the position of the folding box, in particular the folding box shell of the folding box, along the conveying path of the folding boxes from the provisioning section to the filling preparation section, with the control unit also being configured to control the offset device in accordance with the signals received from the sensor unit.

With regard to the offset distance to be applied by the offset device, it must be taken into account that this distance must be large enough so that the cover side flaps of the folding box blanks do not touch one another to ensure that their filling orientation is not impaired. On the other hand, in order to ensure the smallest possible installation space in the offset direction and to realize short cycle times, it is desirable to make the offset distance as small as possible. According to a further exemplary embodiment of the invention, it is therefore proposed that the predetermined offset distance be less than 20%, preferably less than 10% of the length of the folding box in the offset direction.

After completing the filling of the folding boxes, it is generally desirable to discharge them from the filling section to allow for the following folding boxes to be filled and, if desired, to process them further. In a further development of the packaging device according to the invention, it is therefore proposed that said device further comprises a transfer device which is designed and intended to transfer the filled folding boxes from the filling section to a separation preparation section. A transfer direction of the transfer device preferably extends substantially parallel to the first conveying direction.

In order to allow for the folding boxes to be further processed, for example to be closed or the like, the folding boxes that touch one another with their folding box shells must first be separated from one another again. According to a further development of the packaging device according to the invention, it is therefore proposed that said device comprises a separation device which is designed and intended to move the folding boxes along a separation direction from the separation preparation section into a separation section in which the folding boxes that are offset from the offset device are at a distance from the separation preparation section that is smaller than the folding boxes that are not offset. The direction of separation preferably extends opposite to the second conveying direction.

To close the filled and separated folding boxes, the packaging device according to the invention can, according to one embodiment, comprise a further transfer device which is designed and intended to transfer the filled folding boxes from the separation section to a closing section of the packaging device. The transfer direction of the further transfer device preferably extends substantially parallel to the first conveying direction.

If the packaging device according to the invention comprises the aforementioned closing section, it is advantageous not only to minimize a cycle time of the packaging device, if the folding boxes that were separated by the separation section can be closed substantially in the arrangement formed by the separation section in the closing section, without having to perform another realignment or joining of the separated folding boxes in the separation direction. In a further development of this exemplary embodiment, it is therefore proposed that the closing section comprises at least a first and a second closing device with the further transfer device being designed and intended to transfer the folding boxes spaced apart by the smaller amount from the separation preparation section to the first closing device and to transfer the folding boxes space apart by a greater amount from the separation preparation section to the second closing device.

In order to discharge the filled and closed folding boxes from the packaging device, said device can further comprise a discharge device which is designed and intended to discharge the filled and closed folding boxes from the closing section. The discharge device preferably comprises a first partial discharge device, which is designed and intended to transfer the filled and closed folding boxes from the closing section to a discharge section, as well as a second partial discharge device, which is designed and intended to discharge the filled and closed folding boxes from the discharge section and thus the packaging device.

With regard to a further aspect, the invention relates to a method for packaging products, in particular to using a packaging device according to the invention, comprising the following steps:

providing a plurality of folding boxes, each formed from a folding box blank, at a provisioning position in a configuration in which a folding box shell of the particular folding box is arranged with a main cover flap which does not cover a shell opening of the folding box shell and cover side flaps that are arranged such that they project laterally from this main cover flap, conveying the plurality of folding boxes together as a folding box group or individually to form a folding box group along a first conveying direction from the provisioning position to a filling preparation position, wherein at least one of the plurality of folding boxes is offset by a predetermined offset distance in a direction that is orthogonal to the first conveying direction, and wherein the movement of the folding boxes along the first conveying direction is limited in such a way that their folding box shells touch one another, and conveying the group of folding boxes along a second conveying direction from the filling preparation position to a filling position.

Already at this point it should be pointed out that all the advantages and effects of the packaging device according to the invention also apply to the method according to the invention, with reference being made in detail to the statements made above with regard to the packaging device.

It should also be added that the second conveying direction can preferably extend substantially orthogonally to the first conveying direction.

Figure 2:
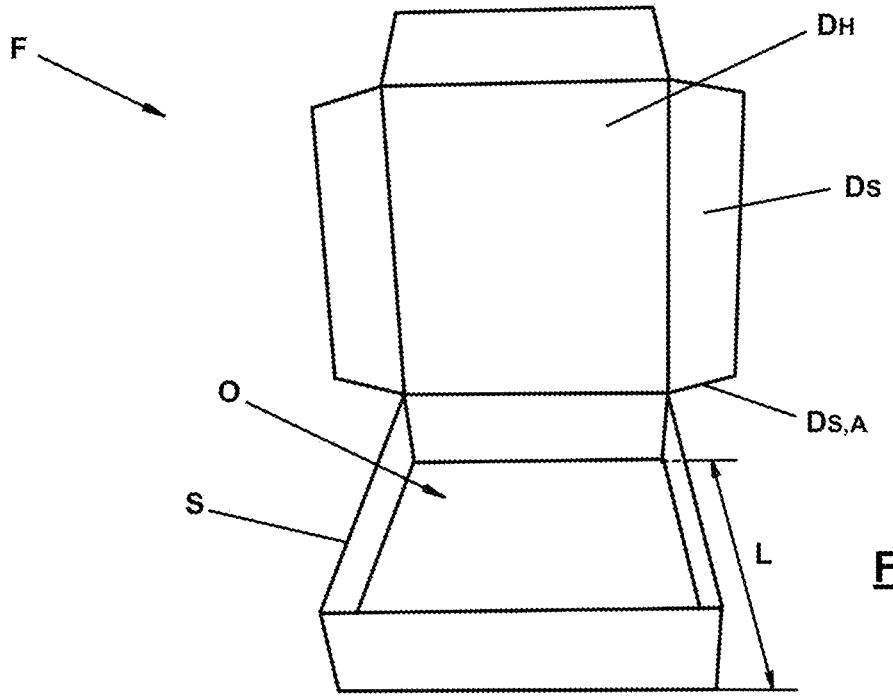
Figure 3:
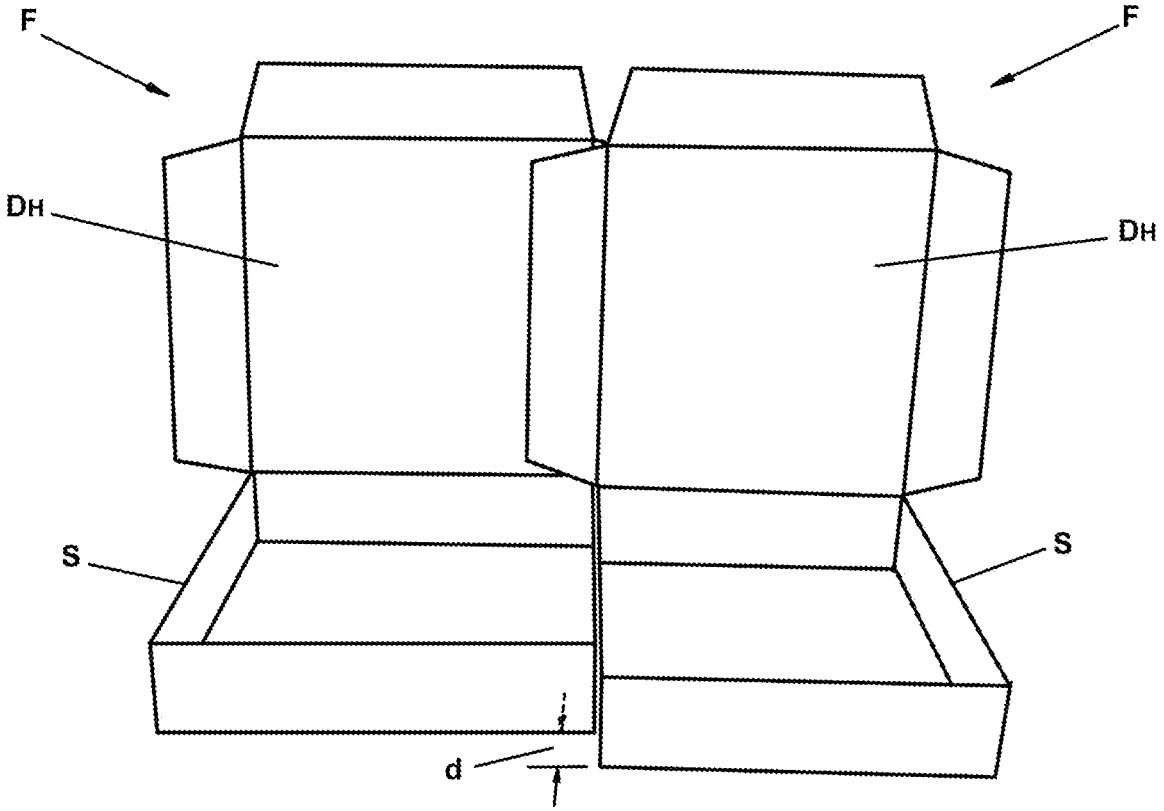

The invention will be explained in more detail below on the basis of an exemplary embodiment using the accompanying drawing. In the figures:

FIG. 1 is a schematic plan view of the packaging device according to the invention, FIG. 2 is a perspective view of a folding box, and FIG. 3 is a perspective view of two adjacent folding boxes which have a filling orientation.

In FIG. 1, a packaging device according to the invention is designated quite generally with the number 100.

The packaging device 100 comprises a provisioning section 110 which is indicated in the illustrated schematic plan view only by a dashed rectangle. In the provisioning section 110, a plurality of folding boxes F each formed from a folding box blank Z is provided by means of a feeding device 102 which is designed, for example, as a conveyor belt or the like.

The folding boxes F have the configuration shown in FIG. 2. In particular, they have a folding box shell S that is arranged in a substantially horizontal direction. A main cover flap $D_H$ projects substantially upwards from one edge of the folding box shell S, so that it does not cover a shell opening O of the folding box shell S. From the main cover flap $D_H$, in turn, cover side flaps Ds project from the side, which are preferably formed with a taper $D_{S,A}$ at least at their ends adjacent to the edge of the folding box shell S. The orientation of the folding boxes F shown in FIG. 2 is also referred to below as the "filling orientation."

There are various possibilities for the manner in which the folding box blanks Z are converted into the configuration described above. For example, the folding box blanks Z can be folded in a folding box shell forming section 190 that is upstream from the provisioning section 110. For this purpose, the packaging device 100 in the illustrated embodiment comprises a total of four supply units 192 for, preferably substantially flat, folding box blanks Z and, for each of the supply units 192, a separate extracting device 194 and a separate folding device 196.

Alternatively, the folding boxes F can also be pre-folded on a device that is separate from the packaging device 100.

With further reference to FIG. 1, the packaging device 100 further comprises a filling preparation section 120 and a filling section 130, which are likewise only indicated by dashed rectangles. For the purpose of conveying the plurality of folding boxes F from the provisioning section 110 to the filling preparation section 120 or the filling section 130, the packaging device 100 further comprises a conveying device 132, which in turn comprises a first partial conveying device 132*a* and a second partial conveying device 132*b*. The first partial conveying device 132*a* and the second partial conveying device 132*b* may also each be designed as a conveyor belt or the like.

The first partial conveyor device 132*a* is designed and intended to transfer the folding boxes F to form the folding box group F** either individually or as a folding box subgroup F* or as an entire folding box group F along a first conveying direction A from the provisioning section 110 to the filling preparation section 120. In the exemplary embodiment shown in FIG. 1, the folding box group F comprises eight folding boxes F, which are transferred to the filling preparation section 120 in two subgroups F* of four folding boxes F each. However, this number is only an example and should not be viewed as limiting in any way. The folding box group F** can also be formed from a higher or lower number of folding boxes F depending on the particular application and the associated requirements with regard to the installation space to be maintained and/or the throughput to be achieved.

An offset device 134 is provided along the conveying path of the folding boxes F from the provisioning section 110 to the filling preparation section 120, which offset device can be designed, for example, as a slider or the like. In the exemplary embodiment shown, the offset device 134 is designed and intended to offset every second folding box F in a direction V (also referred to as the "offset direction") orthogonal to the first conveying direction A by a predetermined offset distance d (see FIG. 3). The predetermined offset distance d can, for example, be less than 20%, preferably less than 10%, of the length L (see FIG. 2) of the folding box F in the offset direction V.

To control the offset device 134, a control unit 180 is provided in the exemplary embodiment shown, which comprises at least one signal input 180*a* for detecting sensor signals from a sensor unit 182 and at least one signal output 180*b*, which is connected to a signal input 134*a* of the offset device 134, to output control signals to the offset device 134. The sensor unit 182 is designed and intended to detect the position of a folding box F along the conveying path of the folding boxes F from the provisioning section 110 to the filling preparation section 120. Consequently, the control unit 180 can control the offset device 134 on the basis of the signals received from the sensor unit 182 such that the offset device 134 offsets every second folding box F of the folding box part group F* in the offset direction V by the offset distance d. The sensor unit 182 can be designed as a contactless sensor, in particular as an optical sensor, for example as a light barrier or as a contact-based sensor, in particular as a mechanical sensor.

In addition, conveyance-limiting means 136*a* are provided in the filling preparation section 120, which limit the movement of the folding boxes F along the first conveying direction A under the action of the first partial conveyor device 132*a*. The conveyance-limiting means 136*a* can be designed, for example, as a stop element.

Due to the offset applied by the offset device 134 and the effect of the conveyance-limiting means 136*a*, the folding boxes F in the filling preparation section 120 have substantially the arrangement shown in FIG. 3, in which the folding box shells S of adjacent folding boxes F come in contact with one another. Due to the offset applied by the offset device 134, the cover side flaps $D_s$ of adjacent folding boxes F overlap with one another. However, there is no risk of the orientation of the folding boxes F being disturbed due to side contact of the cover side flaps $D_s$ of adjacent folding boxes F. Preferably, the cover side flaps Ds projecting laterally from the main cover flap $D_H$ each have a taper $D_{SA}$ at least at their end facing the folding box shell S in order to also avoid contact between the cover side flaps $D_s$ and the folding box shell S of an adjacent folding box F.

The second partial conveying device 132*b* is designed and intended to transfer the folding box group F along a second conveying direction B, which extends substantially orthogonally to the conveying direction A, from the filling preparation section 120 to the filling section 130. In the illustrated embodiment, further conveyance-limiting means 136***b* are provided in the filling section 130, which are designed and intended to substantially cancel the offset of the folding boxes F when a filling position is reached in the filling section 130. The further conveyance-limiting means 136*b* can also be designed as a stop element.

In the filling position, the folding boxes F of the folding box group F can be filled with products to be packaged by means of a filling device (not shown) arranged in the filling section 130, for example a gripper. Due to the fact that the folding boxes F are arranged directly next to one another without an offset, the folding boxes F no longer have to be spread by the filling device during the filling process, whereby the filling process can be significantly simplified and the performance of the packaging device 100** increased considerably.

With further reference to FIG. 1, the packaging device 100 according to the present embodiment further comprises a transfer device 138, which is designed and intended to transfer the filled folding boxes F from the filling section 130 to a separation preparation section 140 indicated by a dashed rectangle. The transfer device 138 can in turn be designed as a conveyor belt or the like.

To separate the folding boxes F, the packaging device 100 can further comprise a separation device 142, which is preferably arranged in the separation preparation section 140, and is designed and intended to move the folding boxes F along a separation direction T to a separation section 150, again indicated by a dashed rectangle. In the illustrated embodiment, the separation direction T extends opposite to the second conveying direction B. The displacement of the folding boxes from the separation preparation section 140 to the separation section 150 takes place in such a way that the separation device 142 offsets the folding boxes F previously offset by the offset device 134 in the filling preparation section 120 by a smaller distance than the non-offset folding boxes F.

To displace the respective folding boxes F, the separation device 142 can comprise a plurality of mutually adjacent separating units 142*b*, for example sliders, which are only indicated schematically in FIG. 1 by arrows pointing in the separation direction T. In the illustrated embodiment, each folding box F of the folding box group F is assigned to a separate separating unit 142***b*, so that each separating unit 142*b* only has to be displaceable in the separation direction T. In order to control the separation device 142 and thus the individual separating units 142*b*, the separation device 142 can further comprise a signal input 142*a*, which is connected to a signal output 180*c* of the control unit 180.

Alternatively, however, a plurality of separating units can be provided which is less than the number of folding boxes F of the folding box group F**. In that case, however, the separating units must not only be displaceable in the separation direction T itself but also in the direction orthogonal to the separation direction T.

To close the filled and separated folding boxes F, the packaging device 100 according to the illustrated embodiment further comprises a closing section 160, likewise only indicated as a dashed rectangle in FIG. 1. In order to be able to transfer the folding boxes F from the separation section 150 to the closing section 160, the packaging device 100 comprises a further transfer device 152, which in turn has a first partial transfer device 152*a* and a second partial transfer device 152*b*, both of which can be configured as a conveyor belt. As a result of this, the filled and separated folding boxes F can be transferred to the closing section 160 in two rows that are offset in the separation direction T and that extend substantially parallel. In the closing section 160, a first closing device 162 and a second closing device 164 can accordingly be provided, each of which is configured to close the folding boxes F arranged in a common row.

The filled and closed folding boxes F can finally be discharged from the packaging device 100 by means of a discharge device 166. For this purpose, the discharge device 166 comprises a first partial discharge device 166*a*, which is designed and intended to transfer the filled and closed folding boxes F from the closing section 160 to a discharge section 170, as well as a second partial discharge device 166*b*, which is designed and intended to discharge the filled and closed folding boxes F from the discharge section 170 and thus from the packaging device 100. The first partial discharge device 166*a* and/or the second partial discharge device 166*b* can each be designed as a conveyor belt or the like.

The invention claimed is:

1. A packaging device comprising:

a feeding device designed and intended to provide, in a provisioning section of the packaging device, a plurality of folding boxes each formed from a folding box blank in a configuration in which a folding box shell of the particular folding box is arranged with a main cover flap that does not cover a shell opening of the folding box shell and cover side flaps that project laterally from this main cover flap, a conveying device designed and intended to convey the plurality of folding boxes from the provisioning section to a filling section, wherein the conveying device comprises a first partial conveying device designed and intended to convey the plurality of folding boxes along a first conveying direction from the provisioning section to a filling preparation section, as well as a second partial conveying device designed and intended to transfer the folding box group along a second conveying direction from the filling preparation section to the filling section, wherein along the conveying path of the folding boxes from the provisioning section to the filling preparation section, an offset device is provided, the offset device is designed and intended to offset at least one of the plurality of folding boxes in a direction extending orthogonally to the first conveying direction by a predetermined offset distance, and further comprising conveyance-limiting means designed and intended to limit the movement of the folding boxes under the action of the first partial conveying device along the first conveying direction, and further conveyance-limiting means designed and intended to cancel the offset distance of the folding boxes as soon as the folding boxes reach a filling position in the filling section.

2. The packaging device according to claim 1, wherein the offset device is designed and intended to offset every second folding box by the predetermined offset distance.

3. The packaging device according to claim 1, further comprising a control unit which comprises at least one signal input for detecting sensor signals and at least one signal output for outputting control signals to the offset device.

4. The packaging device according to claim 3, further comprising a sensor unit connected to the at least one signal input of the control unit, the sensor unit is designed and intended to detect the position of the folding box, in particular the folding box shell of the folding box, along the conveying path of the folding boxes from the provisioning section to the filling preparation section, wherein the control unit is further configured to control the offset device on the basis of the signals received from the sensor unit.

5. The packaging device according to claim 1, wherein the predetermined offset distance is less than 20% of the length of the folding box in the offset direction.

6. The packaging device according to claim 1, further comprising a transfer device designed and intended to transfer the filled folding boxes from the filling section to a separation preparation section.

7. The packaging device according to claim 1, further comprising a separation device designed and intended to displace the folding boxes along a separation direction from the separation preparation section to a separation section, in which the folding boxes offset by the offset device are spaced from the separation preparation section by a smaller amount than the non-offset folding boxes.

8. The packaging device according to claim 7, further comprising a further transfer device designed and intended to transfer the filled and separated folding boxes from the separation section to a closing section of the packaging device.

9. The packaging device according to claim 8, wherein the closing section comprises at least a first and a second closing device, wherein the further transfer device is designed and intended to transfer the folding boxes spaced by the smaller amount from the separation preparation section to the first closing device and to transfer the folding boxes spaced by a greater amount from the separation preparation section to the second closing device.

10. The packaging device according to claim 8, further comprising a discharge device which is designed and intended to discharge the filled and closed folding boxes from the closing section.

11. The packaging device according to claim 10, wherein the discharge device comprises a first partial discharge device designed and intended to transfer the filled and closed folding boxes from the closing section to a discharge section, as well as a second partial discharge device designed and intended to discharge the filled and closed folding boxes from the discharge section and thus the packaging device.

* * * * *